US011260507B2

(12) United States Patent
Su

(10) Patent No.: US 11,260,507 B2
(45) Date of Patent: Mar. 1, 2022

(54) TELESCOPIC TOOL

(71) Applicant: Hong Ann Tool Industries Co., Ltd., Taichung (TW)

(72) Inventor: Cheng-Wei Su, Taichung (TW)

(73) Assignee: Hong Ann Tool Industries Co., Ltd., Taichung (TW)

( * ) Notice: Subject to any disclaimer, the term of this patent is extended or adjusted under 35 U.S.C. 154(b) by 265 days.

(21) Appl. No.: 16/724,695

(22) Filed: Dec. 23, 2019

(65) Prior Publication Data

US 2020/0331127 A1 Oct. 22, 2020

(30) Foreign Application Priority Data

Apr. 22, 2019 (TW) ..... 108113932

(51) Int. Cl.
*B25B 23/00* (2006.01)
*B25G 1/04* (2006.01)

(52) U.S. Cl.
CPC ..... *B25B 23/0021* (2013.01); *B25G 1/043* (2013.01)

(58) Field of Classification Search
CPC ..... B25G 1/04; B25B 23/16; B25B 23/0007; B25B 23/0042
See application file for complete search history.

(56) References Cited

U.S. PATENT DOCUMENTS 6,474,696 B1 * 11/2002 Canale ..... A47L 9/244 285/7
8,511,207 B2 8/2013 Su
9,302,385 B2 4/2016 Su
10,611,013 B2 * 4/2020 Cavaliere ..... B25G 1/04
11,090,798 B2 * 8/2021 Resh ..... B25G 1/04
11,141,852 B2 * 10/2021 Resh ..... B25G 3/18
2011/0002732 A1 1/2011 Su
2020/0215681 A1 * 7/2020 He ..... B25G 1/04

FOREIGN PATENT DOCUMENTS

DE 102009044661 A1 7/2010
TW 554799 U 9/2003
TW M386967 U 8/2010
TW I1370206 B 8/2012
TW 201536489 A 10/2015
TW 201836780 A 10/2018

* cited by examiner

*Primary Examiner* — David B. Thomas
(74) *Attorney, Agent, or Firm* — Alan D. Kamrath; Karin L. Williams; Mayer & Williams PC

(57) ABSTRACT

A telescopic tool includes a positioning device mounted between first and second rods. The first rod includes a longitudinal hole extending along a longitudinal axis, a first positioning hole intercommunicating with the longitudinal hole, and a first gripping portion. The second rod is movably received in the longitudinal hole, includes a plurality of second positioning holes, and is movable relative to the first rod along the longitudinal axis to align the first positioning hole with one of the plurality of second positioning holes. A switch controller is movable relative to the first rod and is movably coupled to a positioning member. The positioning member movably extends through the first hole and is releasably engaged in one of the plurality of second positioning holes in response to movement of the switch controller relative to the first rod. A fixing member includes a second gripping portion mounted around the first rod.

10 Claims, 6 Drawing Sheets

TELESCOPIC TOOL

BACKGROUND OF THE INVENTION

The present invention relates to a telescopic tool and, more particularly, to a telescopic tool permitting gripping by both hands of a user.

Currently available telescopic tools, an example of which is disclosed in Taiwan Patent Publication No. 554799, include a handle for a hand tool, a coupling sleeve, and an extension rod. The extension rod is hollow to permit insertion of a handle. The extension rod extends into and is positioned in an end of the coupling sleeve. The other end of the coupling sleeve includes an eccentric inner wall. A ring is received and restrained by the eccentric inner wall to prevent outward movement. The ring includes an outer periphery having two arcuate raised portions between which a pressing pin is pivotably mounted. The handle extends into the coupling sleeve and the extension rod. The ring is mounted around the handle. When the handle or the extension rod is rotated, the ring pivots at the eccentric inner wall of the coupling sleeve, the two arcuate raised portions enter a narrower portion of the eccentric inner wall, and the ring is compressed to tightly clamp the handle. Furthermore, the rigid pressing pin presses against the handle and the eccentric inner wall of the sleeve to provide a tightening effect. However, this telescopic tool does not allow a user to hold the coupling sleeve. In a case that the user inadvertently applies a force to the coupling sleeve, the handle and the extension rod will become loosened. Furthermore, this telescopic tool does not allow a change of a working portion on a front end of the handle.

Thus, a need exists for a novel telescopic tool that overcomes the above disadvantages.

BRIEF SUMMARY OF THE INVENTION

An objective of the present invention is to provide a telescopic tool including a positioning device mounted between a first rod and a second rod to thereby provide a reliable locking effect. Furthermore, both hands of a user can grip a first gripping portion and a second gripping portion, respectively, thereby permitting easy operation of a switch controller.

A telescopic tool according to the present invention includes a first rod, a second rod, and a positioning device mounted between the first rod and the second rod. The first rod includes a longitudinal hole extending along a longitudinal axis, a first positioning hole, and a first gripping portion. The first positioning hole intercommunicates with the longitudinal hole. The first gripping portion is disposed on an outer periphery of the first rod. The second rod is movably received in the longitudinal hole of the first rod and includes a plurality of second positioning holes in an outer periphery of the second rod. The second rod is movable relative to the first rod along the longitudinal axis to align the first positioning hole with one of the plurality of second positioning holes. The positioning device includes a switch controller, a positioning member, and a fixing member. The switch controller is movable relative to the first rod and is movably coupled to the positioning member. The positioning member movably extends through the first hole and is releasably engaged in one of the plurality of second positioning holes in response to movement of the switch controller relative to the first rod. The fixing member includes a second gripping portion mounted around the first rod. The first gripping portion and the second gripping portion are configured to be held by two hands of a user.

In an example, the second gripping portion has an axial length along the longitudinal axis of the first rod, and the axial length is not smaller than 8 cm.

In an example, the switch controller includes a guiding portion having a first connecting end, a second connecting end opposite to the first connecting end, and a guiding section between the first and second connecting ends. The second connecting end is movably coupled to the positioning member. The guiding section is arcuate. A spacing from the guiding section to the outer periphery of the second rod in a radial direction perpendicular to the longitudinal axis is larger than a spacing from the second connecting end to the outer periphery of the second rod in the radial direction.

In an example, the positioning member includes a neck. The guiding portion includes a guiding groove. The guiding groove extends from the second connecting end through the guiding section and is movably coupled with the neck, such that the positioning portion is actuatable by the guiding portion to releasably engage with one of the plurality of second positioning holes.

In an example, the guiding portion is formed by bending a metal plate to form the first connecting end, the second connecting end, and the guiding section. The positioning device includes an elastic element having two ends abutting against the first rod and the first connecting end, respectively.

In an example, the fixing member includes a fixing portion mounted around the second rod and a sliding groove defined in the fixing portion and the second gripping portion. The switch controller extends through the sliding groove and is movable in a direction parallel to a longitudinal axis of the second rod.

In an example, the switch controller includes a switch and a sliding block. The switch is integrally connected with the sliding block and is exposed outside of the sliding groove. The sliding block is securely connected to the first connecting end.

In an example, the first rod includes a first through-hole intercommunicating with the longitudinal hole. An engaging groove is defined in the outer periphery of the second rod and is opposite to the plurality of second positioning holes. The second gripping portion includes a second through-hole aligned with the first through-hole. The positioning device further includes a limiting member removably extending through the second through-hole and the first through-hole and abuts the engaging groove. The limiting member is selectively stopped by an end wall of the engaging groove in response to sliding movement of the second rod relative to the first rod.

In an example, the second rod includes a distal end having a working portion in a form of a pry bar head.

In an example, the second rod includes a distal end having a working portion in a form of a connecting rod.

Thus, the telescopic tool according to the present invention uses the positioning device to avoid unexpected loosening. Furthermore, the first gripping portion and the second gripping portion can be respectively held by two hands of the user while easily controlling the switch controller to switch between the locking position and the releasing position.

The present invention will become clearer in light of the following detailed description of illustrative embodiments of this invention described in connection with the drawings.

DETAILED DESCRIPTION OF THE INVENTION

Figure 1:
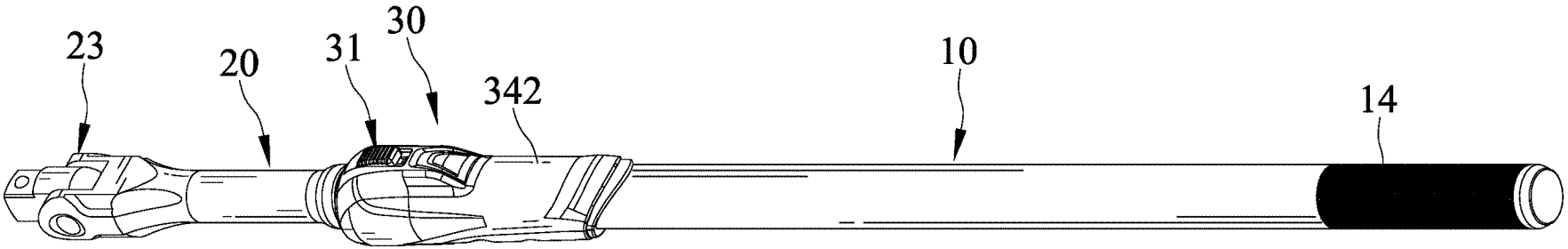
FIG. 1 is a perspective view of a telescopic tool of an embodiment according to the present invention.
Figure 2:
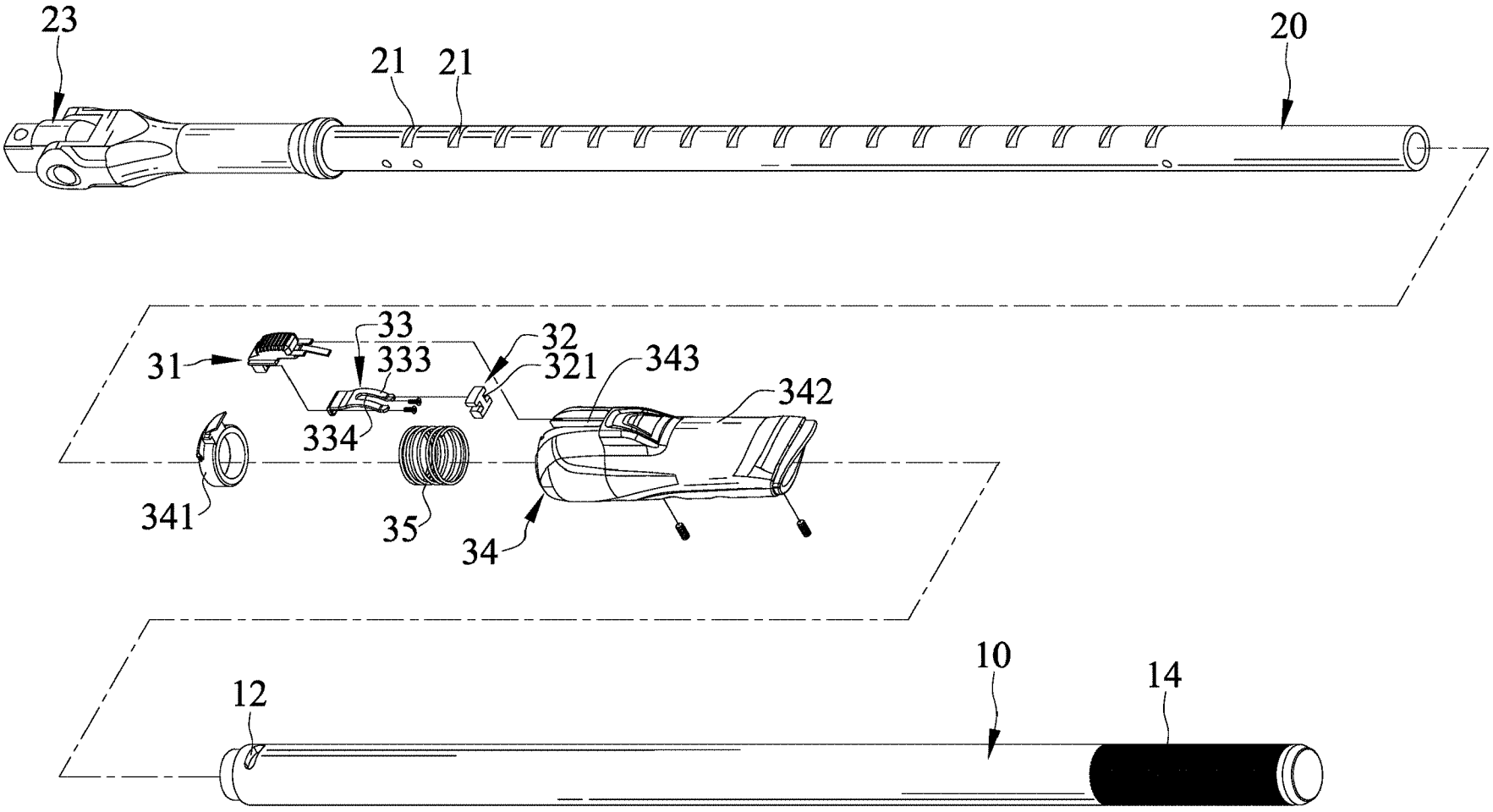
FIG. 2 is an exploded, perspective view of the telescopic tool of FIG. 1.

With reference to FIGS. 1-4, a telescopic tool of an embodiment according to the present invention includes a first rod 10, a second rod 20, and a positioning device 30 mounted between the first rod 10 and the second rod 20. The first rod 10 includes a longitudinal hole 11, a first positioning hole 12, a first through-hole 13, and a first gripping portion 14. The longitudinal hole 11 extends through at least one end of the first rod 10 along a longitudinal axis of the first rod 10. The first positioning hole 12 extends through an outer periphery of the first rod 10 in a radial direction perpendicular to the longitudinal axis and intercommunicates with the longitudinal hole 11. The first through-hole 13 extends through the outer periphery of the first rod 10 in a radial direction perpendicular to the longitudinal axis, intercommunicates with the longitudinal hole 11, and is located on a side of the first rod 10 opposite to the first positioning hole 12. The first gripping portion 14 is disposed on the outer periphery of the first rod 10 and is located at an end of the first rod 10 opposite to the first positioning hole 12.

The second rod 20 is movably received in the longitudinal hole 11 of the first rod 10 and includes a plurality of second positioning holes 21 and an engaging groove 22. The plurality of second positioning holes 21 is defined in an outer periphery of the second rod 20. In this embodiment, the plurality of positioning holes 21 has equal spacing therebetween. The second rod 20 is movable relative to the first rod 10 along the longitudinal axis to align the first positioning hole 12 with one of the plurality of second positioning holes 21. The engaging groove 22 is defined in the outer periphery of the second rod 20 and extends along a longitudinal axis of the second rod 20. The engaging groove 22 is located at a side of the second rod 20 opposite to the plurality of second positioning holes 21. A working portion 23 is disposed on a distal end of the second rod 20. In this embodiment, the working portion 23 is in the form of a connecting rod, such as a socket coupler for coupling with a socket.

The positioning device 30 includes a switch controller 31 and a positioning member 32. The switch controller 31 is movable relative to the first rod 10 between a locking position and a releasing position in a direction parallel to the longitudinal axis of the second rod 20. The switch controller 31 includes a switch 311, a sliding block 312, and a guiding portion 33. The switch 311 is integrally connected with the sliding block 312. The sliding block 312 is connected to the guiding portion 33. The guiding portion 33 is movably connected to the positioning member 32, such that the switch 311, the sliding block 312, and the guiding portion 33 can move jointly when the switch controller 31 moves relative to the first rod 10.

The positioning member 32 extends through the first hole 12, is movable in the radial direction of the first rod 10, and is releasably engaged in one of the plurality of second positioning holes 21 in response to movement of the guiding portion 33 relative to the positioning member 32.

The guiding portion 33 has a first connecting end 331, a second connecting end 332 opposite to the first connecting end 331, a guiding section 333 between the first and second connecting ends 331 and 332, and a guiding groove 334. In this embodiment, the guiding portion 33 is formed by bending a metal plate to form the first connecting end 331, the second connecting end 332, and the guiding section 333. The first connecting end 331 is securely connected to the sliding block 312. The second connecting end 332 is movably connected to the neck 321 of the positioning member 32. The guiding section 333 is arcuate. A spacing from the guiding section 333 to the outer periphery of the second rod 20 in a radial direction perpendicular to the longitudinal axis is larger than a spacing from the second connecting end 332 to the outer periphery of the second rod 20 in the radial direction, providing a height difference between the guiding section 333 and the second connecting end 332 in the radial direction. The guiding groove 334 extends from the second connecting end 332 through the guiding section 333 and is movably coupled with the neck 321 of the positioning member 32. When the switch controller 31 moves relative to the first rod 10, the guiding portion 33 moves relative to the positioning member 32, such that, due to the arrangement of the arcuate guiding section 333 and the height difference between the guiding section 333 and the second connecting end 332, the positioning member 32 is guided by the guiding groove 334 to move relative to the first positioning hole 12 in the radial direction of the first rod 10, thereby engaging with or disengaging from any one of the plurality of second positioning holes 21.

The positioning device 30 further includes a fixing member 34, an elastic element 35, and a limiting member 36. The fixing member 34 includes a fixing portion 341 mounted around the second rod 20 and a second gripping portion 342 mounted around the first rod 10. The fixing member 34 further includes a sliding groove 343 defined in the fixing portion 341 and the second gripping portion 342. The switch 311 extends through the sliding groove 343 and is movable in a direction parallel to the longitudinal axis of the second rod 20. Furthermore, the switch 311 is exposed outside of the sliding groove 343 and, thus, can be manually moved by a user to switch between the locking position and the releasing position. The second gripping portion 342 includes a second through-hole 344 aligned with the first through-hole 13. The second gripping portion 342 has an axial length L342 along the longitudinal axis of the first rod 10, and the axial length L342 is not smaller than 8 cm to permit gripping by the user.

The elastic element 35 has two ends abutting against the first rod 10 and the first connecting end 331 of the first connecting end 331, respectively. The elastic element 35 provides an elastic returning force to bias the switch controller 31 to the locking position when not subjected to a force. In this embodiment, the elastic element 35 is a compression spring mounted around the second rod 20.

The limiting member 36 removably extends through the second through-hole 344 and the first through-hole 13 and abuts the engaging groove 22. The limiting member 36 is selectively stopped by an end wall of the engaging groove 22 in response to sliding movement of the second rod 20 relative to the first rod 10. This avoids the second rod 20 from undesired disengaging from the first rod 10 when the switch controller 31 is in the releasing position.

Figure 3:
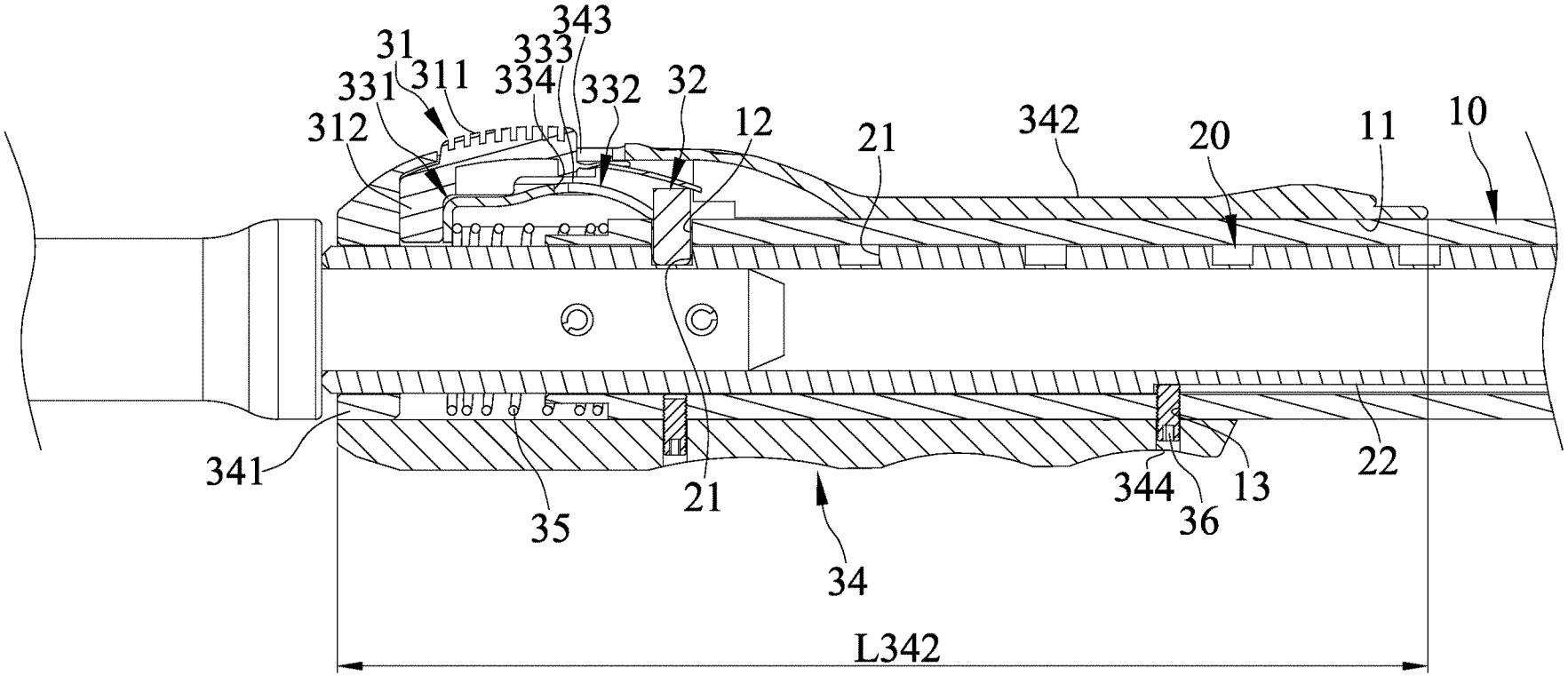
FIG. 3 is a partial, enlarged, cross sectional view of the telescopic tool of FIG. 1.

With reference to FIG. 3 showing the switch controller 31 in the locking position, the neck 321 of the positioning member 32 is coupled with the guiding groove 334 of the guiding portion 33 and is aligned with the second connecting end 332. At this time, the positioning member 32 engages with one of the plurality of second positioning holes 21, such that the second rod 20 cannot move relative to the first rod 10.

Figure 4:
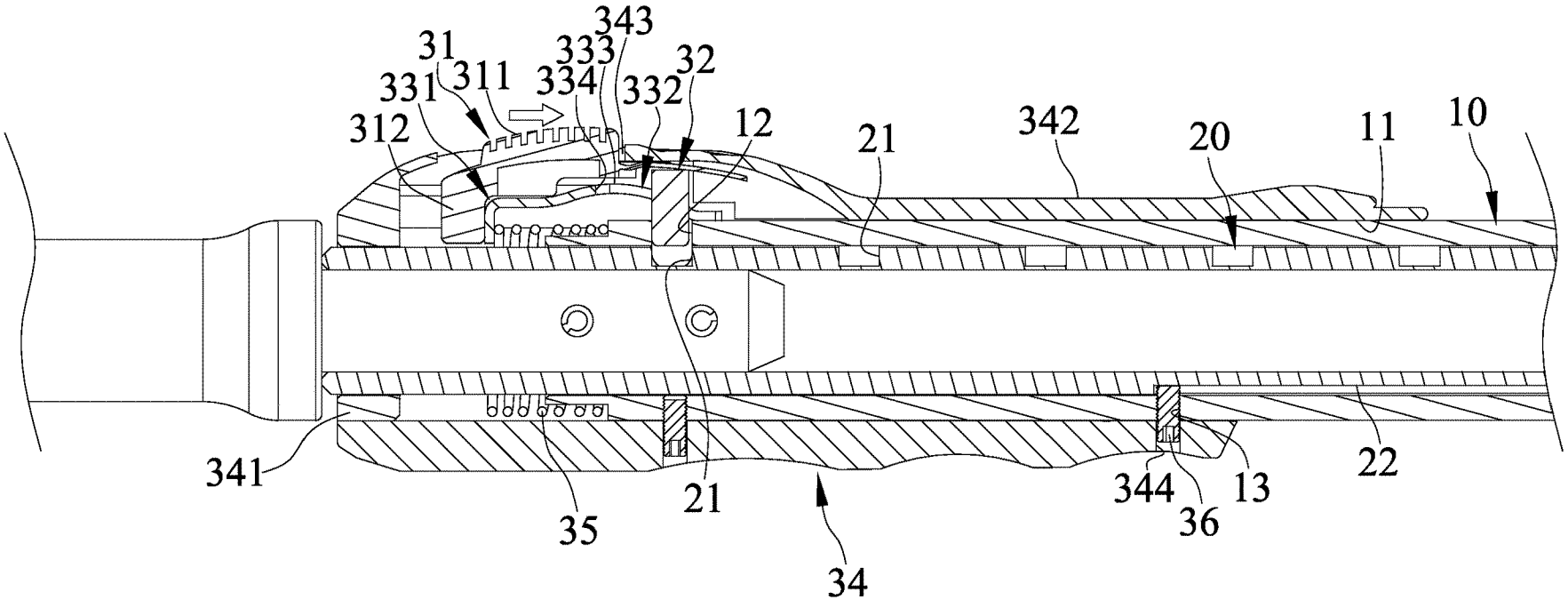
FIG. 4 is a view similar to FIG. 3 with a positioning member disengaged from one of a plurality of second positioning hole.

With reference to FIG. 4, the user can apply a force to the switch 311 to move the switch controller 31 relative to the first rod 10 and the guiding groove 343 in the direction parallel to the longitudinal axis of the second rod 20, thereby switching from the locking position to the releasing position. The guiding portion 33 moves relative to the positioning member 32, such that the neck 321 of the positioning member 32 couples with the guiding groove 334 of the guiding portion 33 and moves away from the second connecting end 332. Furthermore, the neck 321 is aligned with the guiding section 33. Due to the arrangement of the arcuate guiding section 333 and the spacing difference between the guiding section 333 and the second connecting end 332, the positioning member 32 is guided by the guiding groove 334 to move towards the first positioning hole 12 in the radial direction of the first rod 20, thereby disengaging from the previously selected second positioning hole 21. Thus, the second rod 20 can move relative to the first rod 10 as desired, such that another of the plurality of second positioning holes 21 is aligned with the first positioning hole 12. Furthermore, the user can adjust the limiting member 36 to disengage the limiting member 36 from the engaging groove 22 of the second rod 20, such that the second rod 20 can completely disengage from the first rod 10 to permit replacement of the working portion 23 with a different working portion (as will be described with respect to another embodiment to be mentioned hereinafter).

When the another of the plurality of second positioning holes 21 is aligned with the first positioning hole 12, the user can stop applying force to the switch 311. The switch controller 31 returns to the locking position under the action of the returning force of the elastic element 35. The guiding portion 33 moves relative to the positioning member 32. The neck 321 previously aligned with the guiding section 33 returns to a position aligned with the second connecting end 332. At the same time, the positioning member 32 is guided by the guiding groove 334 to move in the radial direction of the first rod 10 relative to the positioning hole 12 and engages with the another of the plurality of second positioning holes 21. Thus, the length of the telescopic tool is adjusted, and the second rod 20 cannot move relative to the first rod 10 to provide a secure locking effect.

Figure 5:
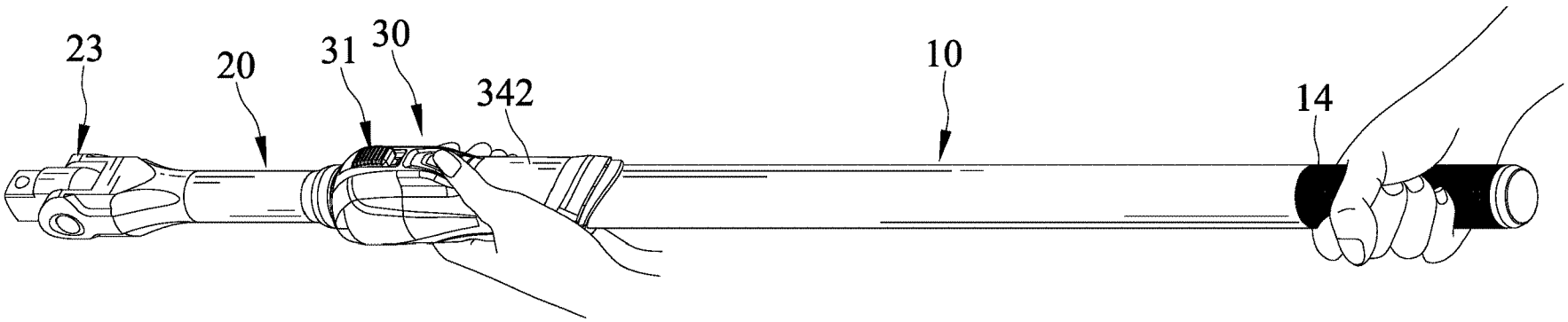
FIG. 5 is a diagrammatic perspective view illustrating use of the telescopic tool of FIG. 1.

With reference to FIG. 5, the first gripping portion 14 and the second gripping portion 342 are configured to be held by two hands of the user. Furthermore, the hand holding the second gripping portion 342 can easily control the switch controller 31 to switch between the locking position and the releasing position. Furthermore, the first gripping portion 14 can be provided with embossing for increasing friction when held by the user.

Figure 6:
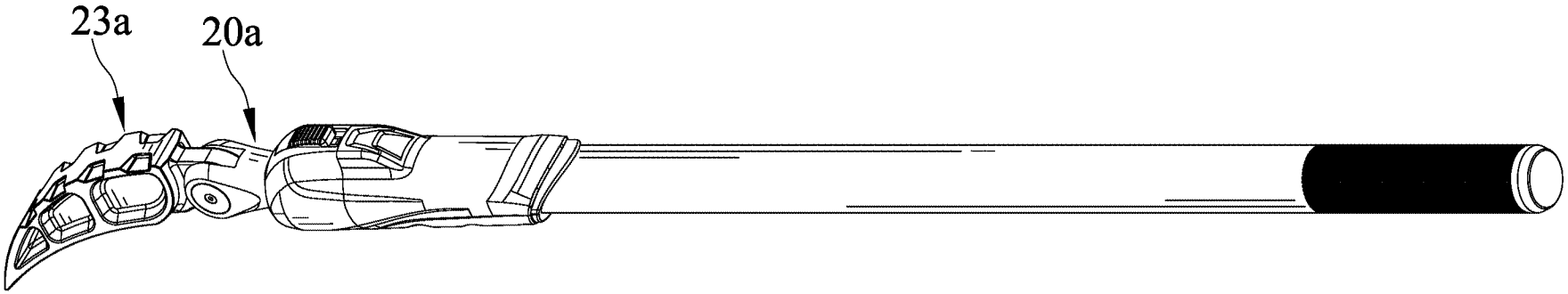
FIG. 6 is a perspective view of a telescopic tool of another embodiment according to the present invention.

FIG. 6 shows a diagrammatic view of a telescopic tool of another embodiment according to the present invention. In this embodiment, the second rod 20*a* includes a distal end having a working portion 23*a* in the form of a pry bar head.

In view of the foregoing, the telescopic tool described in the embodiments according to the present invention uses the positioning device 30 to avoid unexpected loosening. Furthermore, the first gripping portion 14 and the second gripping portion 342 can be respectively held by two hands of the user while easily controlling the switch controller 31 to switch between the locking position and the releasing position.

Although specific embodiments have been illustrated and described, numerous modifications and variations are still possible without departing from the scope of the invention. The scope of the invention is limited by the accompanying claims.

The invention claimed is:

1. A telescopic tool comprising:

a first rod including a longitudinal hole extending along a longitudinal axis, a first positioning hole, and a first gripping portion, wherein the first positioning hole intercommunicates with the longitudinal hole, and wherein the first gripping portion is disposed on an outer periphery of the first rod;

a second rod movably received in the longitudinal hole of the first rod and including a plurality of second positioning holes in an outer periphery of the second rod, wherein the second rod is movable relative to the first rod along the longitudinal axis to align the first positioning hole with one of the plurality of second positioning holes; and a positioning device mounted between the first rod and the second rod, wherein the positioning device includes a switch controller, a positioning member, and a fixing member, wherein the switch controller is movable relative to the first rod and is movably coupled to the positioning member, wherein the positioning member movably extends through the first hole and is releasably engaged in one of the plurality of second positioning holes in response to movement of the switch controller relative to the first rod, wherein the fixing member includes a second gripping portion mounted around the first rod, and wherein the first gripping portion and the second gripping portion are configured to be held by two hands of a user.

2. The telescopic tool as claimed in claim 1, wherein the second gripping portion has an axial length along the longitudinal axis of the first rod, and wherein the axial length is not smaller than 8 cm.

3. The telescopic tool as claimed in claim 1, wherein the switch controller includes a guiding portion having a first connecting end, a second connecting end opposite to the first connecting end, and a guiding section between the first and second connecting ends, wherein the second connecting end is movably coupled to the positioning member, wherein the guiding section is arcuate, and wherein a spacing from the guiding section to the outer periphery of the second rod in a radial direction perpendicular to the longitudinal axis is larger than a spacing from the second connecting end to the outer periphery of the second rod in the radial direction.

4. The telescopic tool as claimed in claim 3, wherein the positioning member includes a neck, wherein the guiding portion includes a guiding groove, and wherein the guiding groove extends from the second connecting end through the guiding section and is movably coupled with the neck, such that the positioning portion is actuatable by the guiding portion to releasably engage with one of the plurality of second positioning holes.

5. The telescopic tool as claimed in claim 3, wherein the guiding portion is formed by bending a metal plate to form the first connecting end, the second connecting end, and the guiding section, and wherein the positioning device includes an elastic element having two ends abutting against the first rod and the first connecting end, respectively.

6. The telescopic tool as claimed in claim 3, wherein the fixing member includes a fixing portion mounted around the second rod and a sliding groove defined in the fixing portion and the second gripping portion, and wherein the switch controller extends through the sliding groove and is movable in a direction parallel to a longitudinal axis of the second rod.

7. The telescopic tool as claimed in claim 6, wherein the switch controller includes a switch and a sliding block, wherein the switch is integrally connected with the sliding block and is exposed outside of the sliding groove, and wherein the sliding block is securely connected to the first connecting end.

8. The telescopic tool as claimed in claim 6, wherein the first rod includes a first through-hole intercommunicating with the longitudinal hole, wherein an engaging groove is defined in the outer periphery of the second rod and is opposite to the plurality of second positioning holes, wherein the second gripping portion includes a second through-hole aligned with the first through-hole, wherein the positioning device further includes a limiting member removably extending through the second through-hole and the first through-hole and abuts the engaging groove, and wherein the limiting member is selectively stopped by an end wall of the engaging groove in response to sliding movement of the second rod relative to the first rod.

9. The telescopic tool as claimed in claim 1, wherein the second rod includes a distal end having a working portion in a form of a pry bar head.

10. The telescopic tool as claimed in claim 1, wherein the second rod includes a distal end having a working portion in a form of a connecting rod.

* * * * *